US005177552A

United States Patent [19]

Isogai et al.

[11] Patent Number: 5,177,552

[45] Date of Patent: Jan. 5, 1993

[54] THERMAL ROLLER FIXING DEVICE FOR THERMALLY FIXING A TONER IMAGE IN ELECTRONIC COPYING MACHINES

[75] Inventors: Mitsuru Isogai; Ikuro Chimoto, both of Toyokawa, Japan

[73] Assignee: Minolta Camera Kabushiki Kaisha, Osaka, Japan

[21] Appl. No.: 805,365

[22] Filed: Dec. 9, 1991

[30] Foreign Application Priority Data

Dec. 13, 1990 [JP] Japan ..... 2-401960
Dec. 14, 1990 [JP] Japan ..... 2-402376

[51] Int. Cl.[5] ..... G03G 15/20

[52] U.S. Cl. ..... 355/285; 428/447; 492/46; 492/56

[58] Field of Search ..... 355/285, 289, 290; 219/216, 388; 432/60; 118/60; 29/132; 427/385.5, 387; 428/446, 447, 450

[56] References Cited

U.S. PATENT DOCUMENTS 4,074,001 2/1978 Imai et al. ..... 428/329
4,360,566 11/1982 Shimizu et al. ..... 118/60 X
4,375,505 3/1983 Newkirk ..... 428/447 X
4,518,655 5/1985 Henry et al. ..... 428/447 X
4,603,087 7/1986 Ema et al. ..... 428/447
4,711,818 12/1987 Henry ..... 428/447 X
4,804,576 2/1989 Kuge et al. ..... 428/447 X
4,970,098 11/1990 Ayala-Esquillin ..... 428/447 X
5,049,444 9/1991 Bingham et al. ..... 428/447 X

*Primary Examiner*—Richard L. Moses
*Attorney, Agent, or Firm*—Willian Brinks Olds Hofer Gilson & Lione

[57] ABSTRACT

A thermal fixing device having a heating roller and a pressing member for thermally fixing a toner image held on the front side of the recording sheet. The heating roller is provided to confront the toner image of the recording sheet and the pressing member is provided to confront the back side of the sheet for making pressure contact with said heating roller through the sheet when the recording sheet is transported between the heating roller and the pressing member. The heating roller and the pressing member respectively include heat-resistant elastic layers the surface of which have the triboelectricity to the recording sheet. The heat-resistant elastic layer of the pressing member has higher triboelectricity to the recording sheet than the heat-resistant elastic layer of the heating roller.

14 Claims, 4 Drawing Sheets

THERMAL ROLLER FIXING DEVICE FOR THERMALLY FIXING A TONER IMAGE IN ELECTRONIC COPYING MACHINES

BACKGROUND OF THE INVENTION

1. Field of the Invention

The present invention relates to a thermal roller fixing device for use in the fixing portion of electronic copying machines and the like.

2. Description of the Related Arts

Conventional thermal roller fixing devices for electronic copying machines provide a heating roller with an internal heater and comprising a conductive core member over which is superimposed a heat-resistant elastic layer formed of silicone rubber or the like, ad a pressure roller which makes pressure contact with said heating roller and comprises a heat-resistant elastic layer superimposed on a core member. In said fixing device, a toner image is fused onto a copy sheet by passing between the heating roller and the pressure roller with the toner image-bearing surface of said copy sheet disposed facing said heating roller.

In recent years, full color image forming apparatus having been developed for forming color images using four types of toner comprising black toner in addition to toners in three primary colors. In said apparatus, the four color toner images are superimposed one over another to form a single image which is then fixed onto the copy sheet to form a full color image. In order to form a full color image having excellent quality and gloss as well as transmission image color reproduction characteristics, a low viscosity toner must be used that readily adheres to the copy sheet and provides excellent transmittance. It is necessary to use a fixing roller that acts uniformly on the surface of the fused toner image so as to maintain the transmittance characteristics of the toner image fused to the copy sheet. In a full color image forming apparatus, therefore, the fixing roller is provided with a coating of a separation material on the surface of said roller to provide as smooth a roller surface as possible so as to act uniformly on the surface of the fused toner image while preventing the low viscosity toner from adhering to the surface of said fixing roller.

Image forming apparatus which form single images by a single toner image, on the other hand, typically provide a separation member on the heating roller side to reliably separate the copy sheet from the heating roller and allow steady transport of said copy sheet between the fixing rollers.

In contrast to the aforesaid image forming apparatus, a full color image forming apparatus which forms a single image by overlaying four color toner images frequently transports the copy sheet bearing a solid (beta) image so as to pass between the fixing rollers. Accordingly, the when a separation member is provided on the heating roller side of the thermal roller fixing device of a full color image forming apparatus, the surface of the copy sheet bearing the toner image comes into contact with said separation member with a high probability that the image quality will be adversely affected thereby. Furthermore, the surface of the fixing roller may be damaged through contact with the separation member, thereby producing defects in the image fused to the copy sheet. If a separation member is not used, however, the copy sheet tends to wrap around the heating roller. This disadvantage becomes particularly marked when the copy sheet used is a neutral paper sheet which contains calcium carbonate.

When the thickness of the heating roller is increased, the copy sheet tends to curl toward the pressure roller side so that the copy sheet separates from the heating roller without using a separation member. However, when the thickness of the heating roller is increased, it becomes difficult to transmit the heat from the internal heater within the roller and said heat accumulates between the metal core member and the heat-resistant elastic layer causing the deterioration of said heat resistant elastic layer.

SUMMARY OF THE INVENTION

A main object of the present invention is to provide a thermal roller fixing device capable of producing fixed images of excellent quality.

A further object of the present invention is to provide a thermal roller fixing device capable of transporting copy sheets between the heating roller and the pressure roller with a high degree of efficiency and stability.

A still further object of the present invention is to provide a thermal roller fixing device capable of transporting copy sheets between the heating roller and the pressure roller with a high degree of efficiency and stability without providing a separation member that may cause defects in the image on the copy sheet and without reducing the thermal conductivity of the heating roller having increased thickness.

These objects of the present invention are achieved by providing a thermal roller fixing device having a heating roller comprising a core member with an internal heater and a heat-resistant elastic layer superimposed on said core member and containing silica; and a pressure roller which makes pressure contact with the aforesaid heating roller, said pressure roller comprising a core member and a heat-resistant elastic layer containing silica superimposed on said core member, wherein the silica content of the heat-resistant elastic layer of said pressure roller is greater than the silica content of the heat-resistant elastic layer of the heating roller.

These objects of the present invention are further achieved by providing a thermal roller fixing device having a heating roller comprising a core member with an internal heater and a silicone rubber layer superimposed on said core member, wherein at least the surface portion of the silicone rubber layer is constructed so as to substantially exclude silica; and a pressure roller which makes pressure contact with the aforesaid heating roller.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
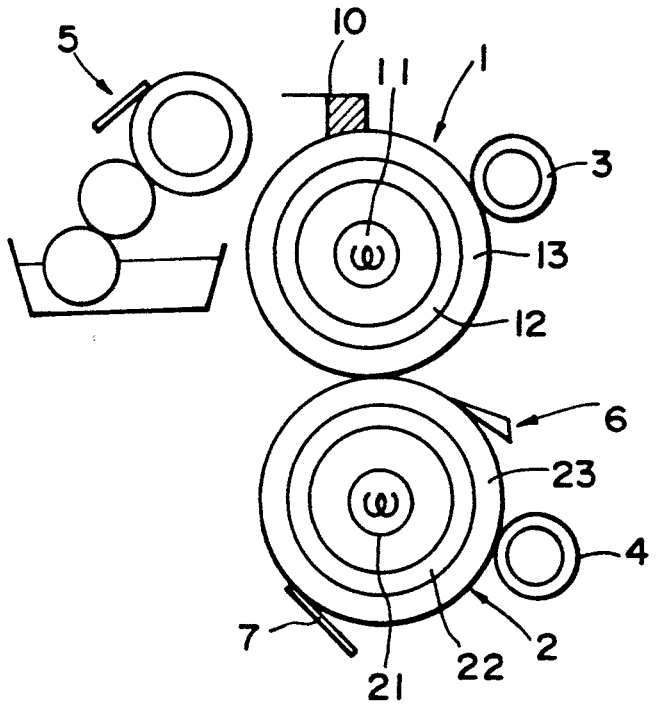
FIG. 1 is a side view showing an embodiment of the thermal roller fixing device of the present invention.
Figure 2:
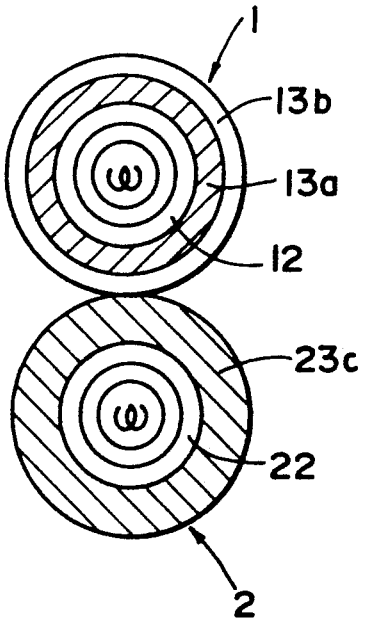
FIG. 2 is a section view showing the roller portion of a first embodiment of the thermal roller fixing device of the invention.

The present embodiment of the thermal roller fixing device mainly comprises a heating roller 1 having an aluminum core member 12 with an internal heater 11 provided therein and a heat-resistant elastic layer 13 superimposed on said aluminum core member 12, pressure roller 2 having an aluminum core member 22 with an internal heater 21 provided therein and a heat-resistant elastic layer 23 superimposed on said aluminum core member 22, cleaning rollers 3 and 4, oil coating unit 5, separation member 6 provided on the pressure roller 2 side, oil collecting blade 7, and temperature sensor 10, as shown in FIG. 1. The heating roller 1 and the pressure roller 2 have a surface roughness Rz 2 μm or less. The heat-resistant elastic layers 13 and 23 comprise silicone rubber composite materials applied to a metal core member, then heat-cured to form the final layer.

First Embodiment

The first embodiment of the thermal roller fixing device has a heating roller 1 with a heat-resistant elastic layer 13 having a dual layer construction, and a pressure roller 2 with a heat-resistant elastic layer 23 having a single layer construction. Furthermore, the heat-resistant elastic layer 13 of the heating roller 1 and the heat-resistant elastic layer 23 of the pressure roller 2 have identical thicknesses.

The heat-resistant elastic layer 13 of the heating roller 1 comprises a metal core member 12 with a silicone rubber layer **13*a* having a thickness of 2 mm and containing 40 percent-by-weight (pbw) silica superimposed on the core member 12 and a silicone rubber layer 13*b* having a thickness of 0.2 mm and excluding silica superimposed on the layer 13*a***.

The heat-resistant elastic layer 23 of the pressure roller 2 comprises a silicone rubber layer **23*c*** having a thickness of 2.2 mm and containing 30 pbw silica.

Second Embodiment

Figure 3:
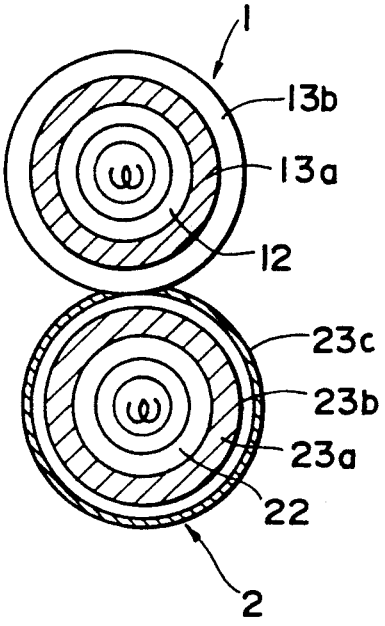
FIG. 3 is a section view showing the roller portion of a second embodiment of the thermal roller fixing device of the present invention.

The second embodiment of the thermal roller fixing device has a heating roller 1 with a heat-resistant elastic layer 13 having a dual layer construction, and a pressure roller 2 with a heat-resistant elastic layer 23 having a triple layer construction, as shown in FIG. 3. Furthermore, the heat-resistant elastic layer 13 of the heating roller 1 and the heat-resistant elastic layer 23 of the pressure roller 2 have identical thicknesses.

The heat-resistant elastic layer 13 of the heating roller 1 comprises a metal core member 12 with a silicone rubber layer **13*a* having a thickness of 2 mm and containing 40 percent-by-weight (pbw) silica superimposed on the core member 12 and a silicone rubber layer 13*b* having a thickness of 0.2 mm and excluding silica superimposed on the layer 13*a***.

The heat-resistant elastic layer 23 of the pressure roller 2 comprises a metal core member 22, a silicone rubber layer **23*a* having a thickness of 1.9 mm and containing 40 pbw silica superimposed on the core member 22, a fluororubber layer 23*b* having a thickness of 0.1 mm superimposed on the silicone rubber layer 23*a*, and a silicone rubber layer 23*c* having a thickness of 0.2 mm and containing 30 pbw silica superimposed on the fluororubber layer 23*b*. The aforesaid fluororubber layer 23*b* prevents oil-induced deterioration of the silicone rubber layer 23*a*, with the effect of extending the service life of the pressure roller 2. The aforesaid silicone rubber layer 23*c* may have a thickness within a practical range of from 0.05 mm up to 80% of the overall thickness of the heat-resistant elastic layer 23**.

Third Embodiment

Figure 4:
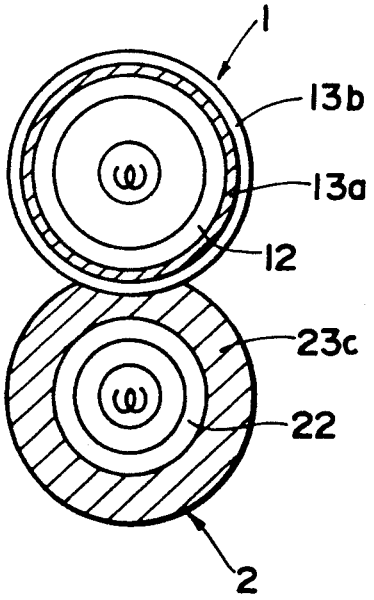
FIG. 4 is a section view showing the roller portion of a third embodiment of the thermal roller fixing device of the present invention.

The third embodiment of the thermal roller fixing device has a heating roller 1 with a heat-resistant elastic layer 13 having a dual layer construction, and a pressure roller 2 with a heat-resistant elastic layer 23 having a single layer construction, as shown in the enlarged section view of FIG. 4. Furthermore, the heat-resistant elastic layer 13 of the heating roller 1 has a thickness which is less than the thickness of the heat-resistant elastic layer 23 of the pressure roller 2. The third embodiment of the thermal fixing device is capable faster high-speed fixing due to the excellent thermal conductivity via the thickness of the heat-resistant elastic layer 13 of the heating roller 1. Furthermore, the accumulation of heat between the metal core member 12 and the heat-resistant elastic layer 13 is minimized due to the aforesaid excellent thermal conductivity, thereby preventing deterioration of said heat-resistant elastic layer 13.

The heat-resistant elastic layer 1 of the heating roller 1 comprises a metal core member 12, silicone rubber layer **13*a* having a thickness of 1 mm and containing 40 pbw silica superimposed on said metal core member 12, and silicone rubber layer 13*b* having a thickness of 0.2 mm and excluding silica superimposed on said silicone rubber layer 13*a***.

Furthermore, the heat-resistant elastic layer 23 of the pressure roller 2 comprises a silicone rubber layer **23*c*** having a thickness of 3 mm and containing 30 pbw silica.

Fourth Embodiment

Figure 5:
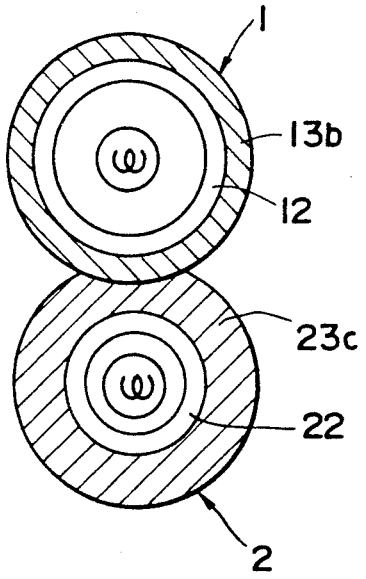
FIG. 5 is a section view showing the roller portion of a fourth embodiment of the thermal roller fixing device of the present invention.

The fourth embodiment of the thermal roller fixing device has a heating roller 1 with a heat-resistant elastic layer 13 having a single layer construction, and a pressure roller 2 with a heat-resistant elastic layer 23 also having a single layer construction, as shown in the enlarged section view of FIG. 5. Furthermore, the heat-resistant elastic layer 13 of the heating roller 1 has a thickness which is less than the thickness of the heat-resistant elastic layer 23 of the pressure roller 2.

The heat-resistant elastic layer 1 of the heating roller 1 comprises a silicone rubber layer **13*b*** having a thickness of 0.2 mm and excluding silica.

The heat-resistant elastic layer 23 of the pressure roller 2 comprises a silicone rubber layer **23*c*** having a thickness of 3 mm and containing 30 pbw silica.

Fifth Embodiment

Figure 6:
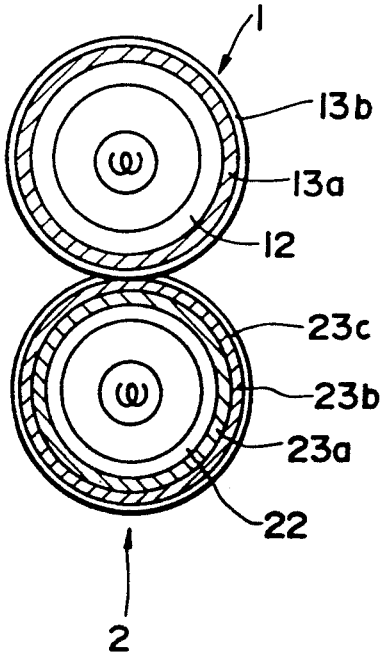
FIG. 6 is a section view showing the roller portion of a fifth embodiment of the thermal roller fixing device of the present invention.
Figure 7:
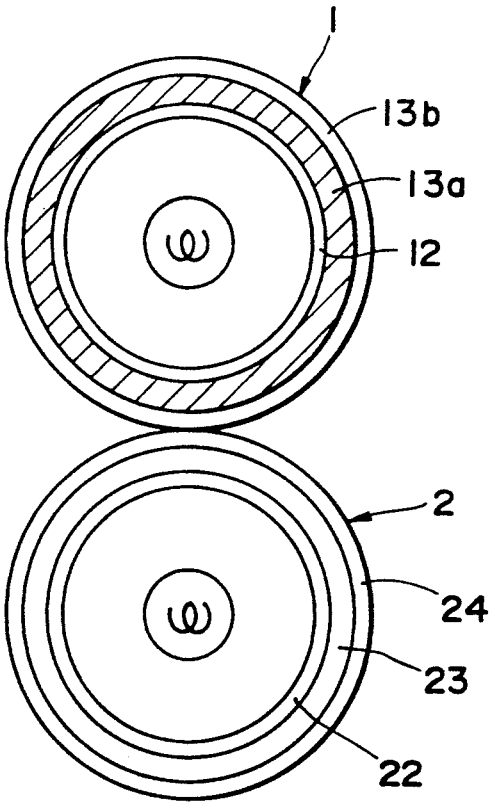
FIG. 7 is a section view showing the roller portion of a sixth embodiment of the thermal roller fixing device of the present invention.

The fifth embodiment of the thermal roller fixing device has a heating roller 1 with a heat-resistant elastic layer 13 having a dual layer construction, and a pressure roller 2 with a heat-resistant elastic layer 23 also having a triple layer construction, as shown in the enlarged section view of FIG. 6. Furthermore, the heat-resistant elastic layer 13 of the heating roller 1 has a thickness which is less than the thickness of the heat-resistant elastic layer 23 of the pressure roller 2.

The heat-resistant elastic layer 13 of the heating roller 1 comprises a metal core member 12, silicone rubber layer 13*a* having a thickness of 1 mm and containing 40 pbw silica superimposed on said metal core member 12, and silicone rubber layer 13*b* having a thickness of 0.2 mm and excluding silica superimposed on said silicone rubber layer 13*a*.

The heat-resistant elastic layer 23 of the pressure roller 2 comprises a metal core member 22, silicone rubber layer 23*a* having a thickness of 3 mm and containing 40 pbw silica superimposed on said metal core member 12, fluororubber layer 23*b* having a thickness of 0.1 mm superimposed on said silicone rubber layer 23*a*, and silicone rubber layer 23*c* having a thickness of 0.2 mm and containing 30 pbw silica superimposed on said fluororubber layer 23*b*.

Sixth Embodiment

The heating roller 1 comprises an aluminum core member 12 (58 mm external diameter, length 320 mm), silicone rubber (Shinochi Kagaku, KE-1330) layer 13*a* having a thickness of 0.8 mm and containing 12 parts silica superimposed on said aluminum core member 12 as a primer layer, and a silicone rubber (Shinochi Kagaku, KE-1935) layer 13*b* having a thickness of 0.2 mm and excluding silica superimposed on said silicone rubber layer 13*a*. The aforesaid heating roller 1 has a surface roughness Rz 1.5 μm.

The pressure roller 2 comprises an aluminum core member (48.5 mm external diameter, 320 mm length) 22, silicone rubber (Shinochi Kagaku, KE-1330) layer 23 having a thickness of 5 mm superimposed on said aluminum core member 12, and a fluororesin (PFA) tube 24 having a thickness of 50 mm superimposed on said silicone rubber layer 24. The aforesaid pressure roller 2 has a surface roughness Rz 1.5 μm.

Furthermore, it is inconsequential if silica particles are not present in the surface layer portion of the silicone rubber of the heating roller 1 even if said heating roller 1 has a single layer construction. In the case of multilayer constructions, the underlayers may be provided characteristics such as oil-resistance, high thermal conductivity and the like. Similar configurations may be used as the pressure roller 2.

The thermal roller fixing devices of the previously described embodiments 1 through 6 were each installed in a copying machine (Minolta Camera Co., Ltd., model CF-70), and 200 sheets of copy paper (neutral sheets, containing calcium carbonate) were passed between the fixing rollers. The aforesaid copy sheets were uniformly transported between the fixing rollers without jamming.

In the thermal roller fixing devices of the present embodiments, the silicone rubber layer 13*b* comprising the outermost layer of the heat-resistant elastic layer 13 of the heating roller 1 does not contain silica, whereas the silicone rubber layer 23*c* comprising the outermost layer of the heat-resistant elastic layer 23 of the pressure roller 2 contains 30 pbw silica. Therefore, the copy sheet and the silica contained in the silicone rubber layer 23*c* are charged and the copy sheet is actually pulled toward or attracted to the pressure roller 2, such that the copy sheet can be separated therefrom by means of the separation member 6 provided on the pressure roller 2 side. Accordingly, the thermal roller fixing device of the present embodiments do not require a separation member on the heating roller 1 side and do not produce image deterioration via said separation member because the image-bearing side of the copy sheet is not pulled toward the heating roller 1.

The silicone rubber layer 23*c* comprising the outermost layer of the heat-resistant elastic layer 23 of the pressure roller 2 has a silica content within the desirable range of from 20 to 60 pbw. When the heat-resistant elastic layer 13 of the heating roller 1 and the heat-resistant elastic layer 23 of the pressure roller 2 have identical thicknesses, the shape of the roller nip becomes flat, such that the copy sheets are transported between the fixing rollers with greater stability. In this case, the stability of the copy sheet transported between the fixing rollers is greatly improved when the silica content of the silicone rubber layer 23*c* on the pressure roller is more than double the silica content of the silicone layer 13*b* of the heating roller 1. Furthermore, when the heat-resistant elastic layer 13 of the heating roller 1 is thinner than the heat-resistant elastic layer 23 of the pressure roller 2, the shape of the roller nip faces upwardly such that the copy sheets are transported with difficulty between the fixing rollers, but said copy sheets are uniformly transported between the fixing roller when the silica content of the silicone rubber layer 23*c* of the pressure roller 2 is increased to more than 2.5 times the silica content of the silicone rubber layer 13*b* of the heating roller 1.

The heating roller 1 and the pressure roller 2 have surface roughnesses Rz 2 μm or less, i.e., a high degree of smoothness. The surface smoothness of the aforesaid rollers is related to the roller charging characteristics, such that image developing via the roller charge becomes difficult to initiate as the surface roughness is reduced. Furthermore, when fixing rollers are used which have high degrees of surface smoothness, the toner image fused on the copy sheet become uniform.

The silica contained in the silicone rubber has a reinforcing effect, and is the effective constituent that assures the physical strength of the heating roller surface. Therefore, it is desirable that the thermal roller fixing device of the present invention provides a heating roller with a multilayer construction of silicone rubber layers, wherein only the outermost layer of the silicone rubber layers substantially excludes silica, whereas the other silicone rubber layers do contain silica so as to assure the physical strength of the heating roller surface. Furthermore, constituents which have a reinforcing effect in the silicone rubber forming the surface portion of at least the silicone rubber layer of the heating roller may alternatively be used, e.g., calcium carbonate, talc, kaolin (porcelain clay), fluoroplastic particles and the like.

Correlation Between Silica Content and Roller Chargeability

The relationship of silica content to roller chargeability was investigated by measuring the roller surface potential when a plurality of copy sheets (neutral paper, 10 pbw calcium carbonate content) were passed between the fixing rollers having a silicone rubber layer with silica contents as shown in Table 1. The measurement results are shown in Table 1. The silicone rubber layers used had a thickness of 1 mm.

TABLE 1

| Silica Content | Surface Potential |
|---|---|
| 30~40 pbw | 6,000~10,000 V |
| 15~20 pbw | 2,000~4,000 V |
| 3~7 pbw | 300~800 V |
| 0 pbw | 100~300 V |

*pbw: percentage-by-weight

As can be understood from the measurement results shown in Table 1, the silica content of the silicone rubber layer greatly influences the chargeability of the roller.

Correlation Between Red Oxide Content and Roller Chargeability

Large quantities of red oxide may be included in the silicone rubber as a heat-resistance enhancing agent. The relationship of red oxide content to roller chargeability was investigated by measuring the roller surface potential in the same manner as previously described using fixing rollers provided with silicone rubber layers containing red oxide and silicone rubber layers excluding red oxide. The measurement results are shown in Table 2. The silicone rubber layers used had a thickness of 1 mm, and all contained 30~40 pbw silica.

TABLE 2

| Silica. Red Oxide Content | Surface Potential |
|---|---|
| Silica: 30~40 pbw<br>Red Oxide: 3 pbw | 6,000~10,000 V |
| Silica: 30~40 pbw<br>Red Oxide: 0 pbw | 6,000~10,000 V |

As can be understood from the measurement results shown in Table 2, the red oxide content of the silicone rubber layer slightly influences the chargeability of the roller.

The relationship of roller chargeability to silica content in the surface portion of a roller having a dual layer construction was investigated by measuring the roller surface potential in the same manner as previously described. The measurement results are shown in Table 3.

TABLE 3

| Layer(s) Silica Content | Surface Potential |
|---|---|
| 1st Layer: 30~40 pbw<br>Outermost Layer: 0 pbw | 100~300 V |
| 1st Layer: 30~40 pbw<br>Outermost Layer: 3~7 pbw | 300~800 V |

As can be understood from the measurement results shown in Table 3, the silica content of the outermost portion of the silicone rubber layer greatly influences the chargeability of the roller.

Correlation Between Silica Content and Stability of Sheet Transport Via Fixing Rollers (hereinafter referred to as "sheet transport stability")

The jamming rates wee investigated by respectively transporting 200 copy sheets A (calcium carbonate content: 6 pbw) and 200 copy sheets B (calcium carbonate content: 9 pbw) between a pressure roller having silicone rubber layers 2 mm in thickness and containing 30 pbw silica and the heating rollers having silicone rubber layers 2 mm in thickness and silica contents as shown in Table 4. The results of the tests are shown in Table 4.

TABLE 4

| Heating Roller Silica Content | 0 pbw | 3 pbw | 15 pbw | 30 pbw |
|---|---|---|---|---|
| Sheet A Jam Rate | 0% | 0% | 0% | 20~30% |
| Sheet B Jam Rate | 0% | 0% | 20~30% | 50% |

It can be readily understood from the measured results shown in Table 4, when the silicone layers of the heating roller and the pressure roller have identical thicknesses, the sheet transport stability is greatly improved when the silica content of the pressure roller is more than double the silica content of the heating roller.

The sheet jamming rates where similarly investigated with the a heating roller silicone layer thickness of 1 mm, and the a pressure roller silicone layer thickness of 3 mm. The measured results are shown in Table 5.

TABLE 5

| Heating Roller Silica Content | 0 pbw | 3 pbw | 15 pbw | 30 pbw |
|---|---|---|---|---|
| Sheet A Jam Rate | 0% | 0% | 20~30% | 50% |
| Sheet B Jam Rate | 0% | 0% | 40~50% | 70~80% |

As can be readily understood from the measured results shown in Table 5, when the silicone layer of the heating roller is thinner than the silicone layer of the pressure roller, sheet jamming occurs more readily than when the thicknesses of both layers are identical.

For the purposes of comparison, a pressure roller provided with a 2 mm thick silicone layer excluding silica was used in conjunction with various heating rollers provided with 2 mm thick silicone layers having the same silica contents as shown in Table 6. The sheet jamming rates were investigated in the same manner as previously described using the aforementioned copy sheets B and copy sheets C (calcium carbonate content: 12 pbw). The measured results are shown in Table 6.

TABLE 6

| Heating Roller Silica Content | 3 pbw | 15 pbw | 30 pbw |
|---|---|---|---|
| Sheet B Jam Rate | 20~30% | 50~60% | 100% |
| Sheet C Jam Rate | 40% | 100% | 100% |

As can be readily understood from the measured results shown in table 6, when only the silicone rubber layer of the heating roller contains silica, the sheet transport stability deteriorates markedly.

The first through sixth embodiments of the present invention assure the physical strength of the surface of the heating roller by providing a heating roller having a multilayer silicone rubber layer construction, wherein only the outermost silicone rubber layer substantially excludes silica whereas the other silicone layers contain silica. Conversely, in the following description the physical strength of the surface of the heating roller is assured by providing the silicone rubber having the composition described below directly on the exterior surface of the core member of the heating roller.

That is, the surface portion of the silicone rubber layer of the heating roller contains (A) diorganopolysiloxane expressed by the following equation (1)

$$R^1_aSi_{(4-a)/2} \quad (1)$$

(where $R^1$ expresses homogeneous or heterogeneous, nonsubstituted or substituted monohydrocarbon group or hydroxide group, and a is a number between 1.98~2.02), and (B) $R^2{}_3SiO_{1/2}$units (wherein $R^2$ is a homogeneous or heterogeneous, nonsubstituted or substituted monohydrocarbon group, hydrolyzable group, hydroxide group, or hydrogen atom-selecting group or atom) and $SiO_2$ units, such that ($R^2{}_3SiO_{1/2}$units)/($SiO_2$ units)=0.5~1.5 (molar ratio). The silicone rubber compositions containing organopolysiloxane, wherein the ≡SiOH group contained in a single molecule is 0.2 moles/100 g or less, is hardened to form the layer.

The aforesaid silicone rubber compositions may comprise an addition-type silicone rubber compound (I) containing (a) diorganopolysiloxane containing two or more unsaturated aliphatic hydrocarbon groups bonded to the silicon atom(s) in a single molecule, as expressed by the aforesaid equation (1), (b) organopolysiloxane containing the aforesaid $R^2{}_3SiO_{1/2}$units and $SiO_2$ units in a molar ratio of 0.5~1.5, and containing one or more ≡SiCH=$CH_2$ group in a single molecule together with ≡SiOH group is 0.01 moles/100 g or less in a single hydrolyzable group) is 0.01 moles/100 g or less, and (c) organohydrogenpolysiloxane containing two or more hydrogen atoms bonded to silicon atom(s) in a single molecule.

A more detailed description of the aforementioned silicone rubber compound follows. The diorganopolysiloxane having the composition (A) comprising the silicone rubber compound of the present invention is expressed by the equation (1) below:

$$R^1{}_aSi_{(4-a)/2} \quad (1)$$

where $R^1$ expresses homogeneous or heterogeneous, nonsubstituted or substituted, monohydrocarbon group or hydroxide group, and a is a number between 1.98~2.02). In this case, a methyl group, ethyl group, propyl group, octyl group, phenyl group, vinyl group, trifluoropropyl group or the like may be used as the monohydrocarbon group. The aforesaid diorganopolysiloxane is preferably a liquid at room temperature, and may contain straight chain, molecular chain, string, or slight three-dimensional structure, and may be a simple polymer, copolymer and compounds of two or more types.

The addition reaction type diorganopolysiloxane used as composition (a) of the previously described compound (I) may have two or more unsaturated aliphatic hydrocarbon groups bonded to the silicon atom(s) in a single molecule. In this case, although a vinyl group and allyl group have been given as examples of the unsaturated aliphatic hydrocarbon group, a vinyl group is desirable. Furthermore, although a methyl group, ethyl group, propyl group, octyl group, phenyl group, vinyl group, trifluoropropyl group and the like have been given as examples of a monohydrocarbon group bonded to the silicon atom(s), a methyl group is desirable. Accordingly, although methylvinylpolysiloxane is desirable as the diorganopolysiloxane of composition (a), suitable constituents are not limited to this structure. Although a phenyl group is advantageous from the standpoint of thermal resistivity, an excess of phenyl group adversely affects the toner and release characteristics when applied to copying machines so that phenyl groups preferably is no more than 5 molar percent of the molecule. Further, although a 3,3,3-trifluoropropyl group improves oil resistivity (dimethylsilicone resistance characteristics), an excess content is disadvantageous relative to release characteristics and cost such that a minimum content is desirable.

Although the aforesaid organopolysiloxane of composition (a) is typically a straight chain, some branching may be permitted. The unsaturated aliphatic hydrocarbon group may be present in either a molecular chain terminus or side chain or both.

The aforesaid organopolysiloxane of composition (a) having a viscosity within a range of $10^2$ ~ $10^6$ cs at a temperature of 25° C. may be used whether said composition is a single composition or a compound, when the final composition is solventless, a viscosity of 100~200,000 cs, and particularly a viscosity of 200~100,000 cs is desirable form the standpoint of the formability characteristics. When the final composition is diluted with, for example, xylene, toluene and the like is applied as a coating on the roller surface, a substantially gum-like organopolysiloxane having a higher viscosity of up to $10^6$cs is usable. In this case, the viscosity of the final composition may be adjusted within a range of 500~10,000 cs, and preferably within a range of 1,000~5,000 cs when the final composition is diluted with solvent.

The (B) component comprising the silicone rubber composition of the present invention is an organopolysiloxane comprising $R^2{}_3SiO_{1/2}$units and $SiO_2$ units. When this component is used as a crosslinking agent the crosslink density of the silicone rubber composition is improved and produces a reinforcing effect. The formulation of the component (B) can impart surface smoothness, friction resistance, and toner releasability to the surface of the roller which are not obtained by the solid filler orientation.

The factor $R^2$ in the $R^2{}_3SiO_{1/2}$unit may be one or two or more types of homogeneous or heterogeneous, nonsubstituted or substituted monohydrocarbon group, hydrolyzable group, hydroxide group or hydrogen atoms, and more specifically the nonsubstituted or substituted monohydrocarbon group may be an alkyl group such as a methyl group, ethyl group, propyl group or the like, an aryl group such as phenyl and the like, an alkenyl group such as a vinyl group, allyl group, isopropehnyl groups and the like, or substituted groups thereof wherein all or some portion of the hydrogen atoms are substituted by halogen atoms such as fluorine atoms and the like, cyano groups, amino groups, nitrile groups and the like (i.e., $CF_3CH_2CH_2CH_2$—and the like). Furthermore, although alkoxy groups, carboxyl groups, amino groups, aminoxy groups, oximine groups, amide groups, imide groups, vinyloxyl groups, lactam groups, halogen atoms and the like are given as examples of the aforementioned hydrolyzable group, it is desirable from the standpoints of the difficulty of synthesis and composition stability that methyl groups comprise 90 molar percent or more of the entire organopolysiloxane of composition (B).

The molar ratio of the $R^2{}_3SiO_{1/2}$unit and $SiO_2$ unit in the organopolysiloxane of composition (B) is 0.1~1.5 moles $R^2{}_3SiO_{1/2}$unit per 1 mole $SiO_2$ unit. When the molar ratio of $R^2{}_3SiO_{1/2}/SiO_2$ is less than 0.5, there is difficulty in synthesizing a solvent-soluble stable organopolysiloxane having low molecular weight, since the obtained composition readily undergoes gelation during synthesis and storage. Furthermore, when the molar ratio of $R^2_3SiO_{\frac{1}{2}}/SiO_2$ exceeds 1.5, the additive effect of the composition (B) is lost.

The organopolysiloxane of composition (B) has a SiOH group molecular content of 0.2 moles/100 g or less.

The aforesaid composition (B) can be synthesized by well known methods. For example, composition (B) may be synthesized by subjecting ethylsilicate, propylsilicate, or like alkylsilicate or partial condensate thereof, or silicon tetrachloride and the like to hydrolytic reaction with an optional halogenosilane in the presence of an organic solvent such as benzene, toluene and the like, and eliminating by-products from the system.

When an addition response type the aforesaid composition (B) is an addition response type composition and particularly when used in compound (I), the organopolysiloxane used has the constituent (b), i.e., the $R^2_3SiO_{\frac{1}{2}}$unit and the $SiO_2$ units, present in a molar ratio of 0.5~1.5. That is, it is desirable from the standpoint of post roller formation release characteristics and the like that the SiOH group contained in a single molecule is present at a ate of 0.01 moles/100 g or less, and the SiX group (where X is a hydrolyzable group) having at least one ≡SiCH=$CH_2$ group contained in a single molecule is present at a rate of 0.01 moles/100 g.

The organopolysiloxane of the composition (B) containing a the $R^2_3SiO_{\frac{1}{2}}$units and the $SiO_2$ units, may contain other units inasmuch as $R^2_2SiO_{2/2}$ units and $R^2SiO_{3/2}$ units are also permissible.

Furthermore, the load of the composition (B) or (b) is preferably 5~100 parts relative to 100 parts of composition (A) or (a), and a load of 10~50 parts is particularly desirable inasmuch as a load exceeding 10 parts causes the roller overcoat layer to become hard and brittle.

The silicone rubber compositions of the present invention may have suitable constituents and curing catalysts contained therein depending on the type of said compositions. For example, an organohydrogenpolysiloxane having two or more hydrogen atoms bonded to silicone atom(s) in a single molecule may be contained in an addition response type composition, particularly as the composition (c) in the aforesaid composition (I). Furthermore, platinum or platinum compounds may be used as a curring catalyst.

The organohydrogenpolysiloxane of composition (c) may function as the organopolysiloxane of the aforesaid compositions (a) and (b). When the aforesaid composition (c) has two or more ≡SiH bonds per single molecule, said composition in not limited to the previously described structure, inasmuch as chain, branch and ring structure are also permissible, examples of which are shown below.

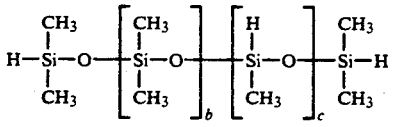

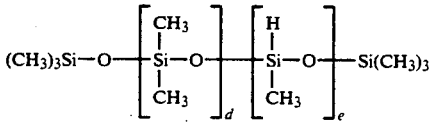

(Where b, c and d express integers or zero, and e expresses an integer two or greater.)

-continued

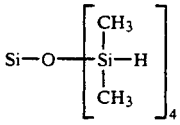

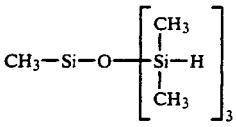

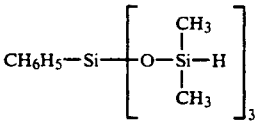

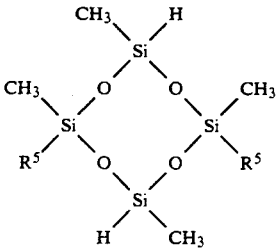

(Where $R^5$ expresses hydrogen atom(s), methyl group, propyl group, or trimethylsilyl group.)

The number of ≡SiH groups contained in the organohydrogenpolysiloxane of composition (c) is suitable selected in accordance with the number of unsaturated aliphatic hydrocarbon groups of composition (a). For example, when the diorganopolysiloxane of composition (a) has two unsaturated aliphatic hydrocarbon groups per molecule, it is desirable that the organohydrogenpolysiloxane of composition (c) have three or more ≡SiH bonds.

The quantity of composition (c) used is desirably such as to provide 0.5~20 ≡SiH bonds relative to a single unsaturated aliphatic hydrocarbon group directly bonded to a silicon atom of compositions (a) and (b), and is preferably such as to provide 1~10 such ≡SiH bonds.

Useful platinum or platinum compounds added as a curing catalyst to the addition response type silicone rubber composition generally can be well known addition response type catalysts such as, for example, platinum black or solid platinum held on a carrier such as alumina, silica and the like, chloroplatinate, alcohol-denatured chloroplatinate, chloroplatinate-olefin complex, platinum-vinylsiloxane complex and the like. When the aforesaid catalysts are used as solids, it is desirable to thoroughly pulverize the particles, thereby minimizing the particle diameter of the carriers to maximize the specific surface area so as to improve dispersion characteristics. It is further desirable to dissolve chloroplatinate or chloroplatinate-olefin complex in a solvent such as alcohol, ketone, ether, or hydrocarbon solvent or the like. The catalyst load is the catalyst quantity. Although the catalyst quantity may be suitably adjusted to achieve a desired curing speed, it is desirable that catalysts compatible with siloxane such as chloroplatinate and the like provide platinum in a range of 5~500 ppm, and preferably in a range of 10~200 ppm, relative to the total quantity of the aforesaid compositions (a) through (c).

Organohydrogensilane may be used in the addition response type silicone rubber composition instead of the aforesaid composition (c) as required. Furthermore, rhodium and palladium catalysts may be used instead of the previously mentioned platinum catalysts.

Still further, addition response control agents (acetylene alcohol type and the like) may be added to the addition type composition as necessary.

Coloring agents, thermal resistance enhancers agents (red oxide, black red oxide, cerium oxide and the like), flame retarding agent (carbon, titanium oxide, benzotriazole, zinc carbonate, manganese carbonate and the like), expanding agents and the like may be added as necessary to the various silicone rubber components used by the present invention. Furthermore, inert silicone oil may be added as a lubricating agent.

The heating roller of the present invention may be produced by directly forming the previously described silicone rubber composition layer on the exterior surface of a core member, or forming a well-known filled addition-cured type silicone rubber elastic layer on a core member, then superimposing thereon a nonfiller loaded silicone rubber composition layer of the present invention and curing said layer so as to produce a hardened rubber layer construction having a dual or multilayer layer structure. Furthermore, methods may be used wherein the aforesaid hardened silicone rubber composition is adhered to the exterior surface of a core member, or a hardened layer of the aforesaid silicone rubber composition is the outermost layer of the heating roller.

In this case, the thickness of the cured silicone rubber layer of the present invention may suitably selected in accordance with the shape of the electrically conductive core member, type of material, kind of device and the like. Furthermore, the method for forming the rubber layer of the aforesaid silicone rubber composition can also be a spray coating using the composition diluted with solvent, and heating the coating so as to provide an overcoating layer on the surface of the core member.

The curing conditions of the aforesaid silicone rubber composition are not particularly limited inasmuch as suitable conditions may be selectively used, and more specifically the conditions may be such that the curing conditions for the addition type silicone rubber composition (I) are heating said layer at a temperature of 100°~150° C. for 3 to 15 min, and a postcure process may be used comprising heating the layer at a temperature of 150°~200° C. for 30 min to 2 hrs.

A seventh embodiment of the present invention is described hereinafter.

In the following examples, the term "part" refers to "part-by-weight," and viscosity refers to viscosity at 25° C.

One hundred parts dimethylpolysiloxane having a viscosity of 10,000 cs and blocked at both ends with dimethylvinylsilicyl groups and 20 parts copolymer (1) described below were added to chloroplatinate alcohol solution as 40 ppm platinum metal relative to the total quantity of the aforesaid two components. After the solution was mixed well, 6.8 parts methylhydrogenpolysiloxane (SiH 0.005 moles/g) having SiH groups at both ends and a portion of a side chain were added, mixed, and used as copolymer (1) to regulate the composition No. 1 (second embodiment).

Copolymer (1)

The copolymer (1) is an organopolysiloxane polymer comprising $(CH_3)_2(CH_2{=}CH)SiO_{0.5}$ units, $(CH_3)_3SiO_{0.5}$ units and $SiO_2$ units, wherein the sum of the molar ratios of the $(CH_3)_2(CH_2{=}CH)SiO_{0.5}$ units and $(CH_3)_3SiO_{0.5}$ units relative to the $SiO_2$ units is 1.0, the vinyl group content is 0.06 moles/100 g, $\equiv$SiOH group content is 0.006 moles/100 g, and the $\equiv SiOCH_3$ group content is 0.007 moles/100 g.

For the purpose of comparison, a composition No. 2 (Relative Example 2) was regulated in the same manner as described above, except that 12 parts fume silica (specific surface area: 200 $m^2/g$) processed with trimethylsilyl group was used on the surface instead of 20 parts of the aforesaid copolymer, and the quantity of methylhydrogen-polysiloxane used was 2.0 parts.

The obtained composition was press-formed at 120° C. for 10 min to form a silicone rubber sheet 2.0 mm thick. A postcuring process was executed at 200° C. for 4 hrs, and physical properties were measured in accordance with JIS-K6301.

The aforesaid two compositions were both injection molded onto aluminum core members (30 mm major diameter, 230 mm length) at 140° C. for 100 seconds, then postcured at 200° C. for 4 hrs to produce the heating rollers of the second embodiment and the relative example 2. Each heating roller was used until offset to investigate the release serviceability. The measured results are shown in Table 7.

TABLE 7

| | | Embodiment 2 Composition No. 1 Copolymer (1) | Relative Ex. 2 Composition No. 2 Fume Silica |
|---|---|---|---|
| Sheet Physical Properties | Hardness (JIS · A) | 40 | 40 |
| | Extension (%) | 210 | 220 |
| | Tensile Strength ($kgf/cm^2$) | 52 | 48 |
| Release Service Properties | Total Sheets to Offset (No.) | 140,000 | 60,000 |
| | Surface Condition at Offset | Mirror Surface | Fogged |

As can be understood from the measurement results shown in Table 7, the seventh embodiment of the heating roller having a hardened silicone rubber layer excluding silica provided excellent release serviceability.

Although the present invention has been fully described by way of examples with reference to the accompanying drawings, it si to be noted that various changes and modification will be apparent to those skilled in the art. Therefore, unless otherwise such changes and modification depart from the scope of the present invention, they should be construed as being included therein.

What is claimed is:

1. A thermal fixing device for thermally fixing a toner image held on the front side of a recording sheet, which comprises:

a heating roller provided to confront the toner image of the sheet and including a silicone rubber layer of double layer construction having a surface portion which is constructed so as to substantially exclude silica and an inner layer which contains silica; and a pressing member provided to confront the back side of the recording sheet for making pressure contact with said heating roller through the sheet when the recording sheet is transported between the heating roller and the pressing member.

2. A thermal fixing device for thermally fixing a toner image held on the front side of a recording sheet, which comprises:

a heating roller provided to confront the toner image of the sheet and including a silicone rubber layer at lest a surface portion of which is constructed so as to substantially exclude silica; and a pressing member provided to confront the back side of the recording sheet for making pressure contact with said heating roller through the sheet when the recording sheet si transported between the heating roller and the pressing member, wherein at least the surface portion of the silicone rubber layer is formed of a silicone rubber compound which contains:

(A) diorgano-polysiloxane expressed by the equation (1); $R^1_aSi_{(4-a)/2}$ (where $R^1$ expresses homogeneous or heterogeneous, nonsubstituted or substituted monohydrocarbon group or hydroxide group, and is a number between 1.98–2.02); and (B) organopolysiloxane containing $R^2_3SiO_{\frac{1}{2}}$units (wherein $R^2$ is a homogeneous or heterogeneous, nonsubstituted or substituted monohydrocarbon group, hydrolyzable group, hydroxide group, or hydrogen atom-selecting group or atom) and $SiO_2$ units in a molar ratio of 0.5–1.5, wherein the ≡SiOH group contained a single molecule is 0.2 moles/100 g or less.

3. A thermal fixing device for thermally fixing a toner image held on the front side of a recording sheet, which comprises:

a heating roller provided to confront the toner image of the sheet and including a silicone rubber layer at least a surface portion of which is constructed so as to substantially exclude silica; and a pressing member provided to confront the back side of the recording sheet for making pressure contact with said heating roller through the sheet when the recording sheet is transported between the heating roller and the pressing member, wherein at least the surface portion of the silicone rubber layer is formed of a silicone rubber compound which contains:

(a) diorganopolysiloxane containing two or more unsaturated aliphatic hydrocarbon groups bonded to the silicone atom(s) in a single molecule, as expressed by the equation (1); $R^1_2Si_{(4-a)/2}$ (where $R^1$ stresses homogeneous or heterogeneous, nonsubstituted or substituted monohydrocarbon group or hydroxide group, and a is a number between 1.98–2.02)

(b) organopolysiloxane containing $R^2_3SiO_{\frac{1}{2}}$units (wherein $R^2$ is a homogeneous or heterogeneous, nonsubstituted or substituted monohydrocarbon group, hydrolyzable group, hydroxide group, or hydrogen atom-selecting group or atom) and $SiO_2$ units in a molar ratio of 0.5–1.5, and containing one or more ≡SiOH═$CH_2$ group in a single molecular together with ≡SiOH group is 0.01 moles/100 g or less in a single molecule, and the ≡SiX group (wherein X is a hydrolyzable group) is 0.01 moles/100 g or less; and (c) organohydrogenpolysiloxane containing two or more hydrogen atoms bonded to silicone atom(s) in a single molecule.

4. A thermal fixing device for thermally fixing a toner image held on the front side of the recording sheet, which comprises:

a heating roller provided to confront the toner image of the recording sheet and including a silicone rubber layer at least a surface portion of which is formed of a silicone rubber compound which contains:

(A) diorganopolysiloxane expressed by the equation (1); $R^2_aSi_{(4-a)/2}$ (where $R^1$ expresses homogeneous or heterogeneous, nonsubstituted or substituted monohydrocarbon group or hydroxide group, and a is a number between 1.98–2.02); and (B) organopolysiloxane containing $R^2_3SiO_{\frac{1}{2}}$units (wherein $R^2$ is a homogeneous or heterogeneous, nonsubstituted or substituted monohydrocarbon group, hydrolyzable group, hydroxide group, or hydrogen atom-selecting group or atom) and $SiO_2$ units in a molar ratio of 0.5–1.5, wherein the ≡SiOH group contained a single molecule is 0.2 moles/100 g or less; and a pressing member provided to confront the back side of the recording sheet for making pressure contact with said heating roller through the sheet when the recording sheet is transported between the heating roller and the pressing member.

5. A thermal fixing device as claimed in claim 4 wherein the load of the composition (B) is preferably 5–100 parts relative to 100 parts of composition (A).

6. A thermal fixing device for thermally fixing a toner image held on the front side of the recording sheet, which comprises:

a heating roller provided to confront the toner image of the recording sheet and including a silicone rubber layer at least a surface portion of which is formed of a silicone rubber compound which contains:

(a) diorganopolysiloxane containing two or more unsaturated aliphatic hydrocarbon groups bonded to the silicone atoms(s) in a single molecule, as expressed by the equation (1); $R^1_aSi_{(4-a)/2}$ (where $R^1$ expresses homogeneous or heterogeneous, nonsubstituted or substituted monohydrocarbon group or hydroxide group, and a is a number between 1.98–2.02);

(b) organopolysiloxane containing $R^2_3SiO_{\frac{1}{2}}$units (wherein $R^2$ is a homogeneous or heterogeneous, nonsubstituted or substituted monohydrocarbon group, hydrolyzable group, hydroxide group, or hydrogen atom-selecting group or atom) and $SiO_2$ units in a molar ratio of 0.5–1.5, and containing one or more ≡SiOH═$CH_2$ group in a single molecule together with ≡SiOH group is 0.01 moles/100 g or less in a single molecule, and the ≡SiX group (wherein X is a hydrolyzable group) is 0.01 moles/100 g or less; and (c) organohydrogenpolysiloxane containing two or more hydrogen atoms bonded to silicone atom(s) in a single molecule; and a pressing member provided to confront the back side of the recording sheet for making pressure contact with said heating roller through the sheet when the recording sheet is transported between the heating roller and the pressing member.

7. A thermal fixing device as claimed in claim 6 wherein the load of the composition (b) is preferably 5-100 parts relative to 100 parts of composition (a).

8. A thermal fixing device for thermally fixing a toner image held on the front side of the recording sheet, which comprises:

a heating roller provided to confront the toner image of the recording sheet and including a heat-resistant elastic layer which contains silica; and a pressing member provided to confront the back side of the recording sheet for making pressure contact with said heating roller through the sheet when the recording sheet is transported between the heating roller and the pressing member, wherein a heat-resistant elastic layer containing silica is provided at the pressing member and the silica content of the heat-resistant elastic layer of said pressing member being greater than the silica content of the heat-resistant elastic layer of the heating roller.

9. A thermal fixing device as claimed in claim 8 wherein the heat-resistant elastic layer of the heating roller is silicone rubber layer of a double layer construction only an inner layer of which contains silica, and the heat-resistant elastic layer of the pressing member is a silicone rubber layer of a single layer construction which contains silica.

10. A thermal fixing device as claimed in claim 8 wherein the heat-resistant elastic layer of the heating roller is a silicone rubber layer of a double layer construction an outer layer of which contains silica, and the heat-resistant elastic layer of the pressing member is composed of an inner layer and an outer layer both of which are formed of silicone rubber containing silica and a middle layer therebetween which is formed of fluororubber.

11. A thermal fixing device as claimed in claim 8 wherein the thickness of the heat-resistant elastic layer of the heating roller is less than the thickness of the heat-resistant elastic layer of the pressing member.

12. A thermal fixing device for thermally fixing a toner image held on the front side of the recording sheet, which comprises:

a heating roller provided to confront the toner image of the recording sheet and including a heat-resistant elastic layer which does not contain silica; and a pressing member provided to confront the back side of the recording sheet and provided with a heat-resistant elastic layer containing silica for making pressure contact with said heating roller through the sheet when the recording sheet is transported between the heating roller and the pressing member.

13. A thermal fixing device as claimed in claim 12 wherein each of the heating roller and the pressing member has the heat-resistant elastic layer of silicone rubber.

14. A thermal fixing device for thermally fixing a toner image held on the front-side of a recording sheet, which comprises:

a heating roller confronting the toner image o the recording sheet and including a heat-resistant elastic layer the surface of which has triboelectricity to the recording sheet; and a pressing member confronting the back side of the recording sheet for making pressure contact with said heating roller through the sheet when the recording sheet is transported between the heating roller and the pressing member, said pressing member being provided with a heat-resistant elastic layer the source of which has triboelectricity to the recording sheet which is higher than the triboelectricity of the surface of the heat-resistant elastic layer of the heating roller to the recording sheet.

* * * * *

UNITED STATES PATENT AND TRADEMARK OFFICE

CERTIFICATE OF CORRECTION

PATENT NO. : 5,177,552

DATED : January 5, 1993

INVENTOR(S) : Mitsuru Isogai, et al.

It is certified that error appears in the above-identified patent and that said Letters Patent is hereby corrected as shown below:

In Col. 1, line 16, change "ad" to --and--.

In Col. 1, line 25, change "having" to --have--.

In Col. 1, line 57, delete "the".

In Col. 4, line 40, change "elastic layer 1" to --elastic layer 13--.

In Col. 4, line 63, change "elastic layer 1" to --elastic layer 13--.

In Col. 7, line 62, change "wee" to --were--.

In Col. 9, line 23, change --≡SiCH≡$CH_2$" to --≡SiCH=$CH_2$--.

In Col. 9, line 25, after "single" insert -- molecule, and the ≡SiX group (wherein X is a--.

UNITED STATES PATENT AND TRADEMARK OFFICE

CERTIFICATE OF CORRECTION

PATENT NO. : 5,177,552

DATED : January 5, 1993

INVENTOR(S) : Mitsuru Isogai, et al.

It is certified that error appears in the above-identified patent and that said Letters Patent is hereby corrected as shown below:

In Col. 10, line 16, change "form" to --from--.

In Col. 11, line 23, change "ate" to --rate--.

In Col. 11, line 28, delete "a".

In Col. 11, line 50, change "in" to --is--.

In Col. 11, line 52, change "structure" to --structures--.

In Col. 14, line 57, change "si" to --is--.

In Col. 15, line 14 (claim 2, line 6), change "lest" to --least--.

In Col. 15, line 19 (claim 2, line 11), change "si" to --is--.

In Col. 15, line 55 (claim 3, line 19), change "$R_2^1$" to --$R_3^1$--.

In Col. 15, line 56 (claim 3, line 20), change "stresses" to --expresses--.

UNITED STATES PATENT AND TRADEMARK OFFICE

CERTIFICATE OF CORRECTION

PATENT NO. : 5,177,552

DATED : January 5, 1993

INVENTOR(S) : Mitsuru Isogai, et al.

It is certified that error appears in the above-identified patent and that said Letters Patent is hereby corrected as shown below:

In Col. 15, line 66 (claim 3, line 30), change "molecular" to --molecule--.

In Col. 16, line 15 (claim 4, line 10), change "$R_a^2$" to --$R_a^1$--.

In Col. 17, line 33 (claim 10, line 4), change "outer" to --inner--.

In Col. 18, line 23 (claim 14, line 2), change "front-side" to --front side--.

In Col. 18, line 25 (claim 14, line 4), change "o" to --of--.

In Col. 18, line 35 (claim 14, line 14), change "source" to --surface--.

Signed and Sealed this

Seventh Day of December, 1993

Bruce Lehman

*Attest:*

BRUCE LEHMAN

*Attesting Officer*

*Commissioner of Patents and Trademarks*